US010945505B2

(12) United States Patent
Clifton

(10) Patent No.: US 10,945,505 B2
(45) Date of Patent: Mar. 16, 2021

(54) CONSTRICTING HAIR CAP

(71) Applicant: Devin Ann Clifton, Homosassa, FL (US)

(72) Inventor: Devin Ann Clifton, Homosassa, FL (US)

( * ) Notice: Subject to any disclaimer, the term of this patent is extended or adjusted under 35 U.S.C. 154(b) by 26 days.

(21) Appl. No.: 16/503,861

(22) Filed: Jul. 5, 2019

(65) Prior Publication Data

US 2020/0008551 A1 Jan. 9, 2020

Related U.S. Application Data

(60) Provisional application No. 62/694,471, filed on Jul. 6, 2018, provisional application No. 62/728,926, filed on Sep. 10, 2018.

(51) Int. Cl.
*A45D 20/02* (2006.01)
*A45D 8/40* (2006.01)

(52) U.S. Cl.
CPC ..... *A45D 20/02* (2013.01); *A45D 8/40* (2013.01)

(58) Field of Classification Search
CPC .... A45D 8/40; A45D 2/46; A42B 1/04; A42B 1/048; A42B 1/12; A42B 1/2225; A42B 1/041; A42B 1/006
USPC ..... 2/174
See application file for complete search history.

(56) References Cited

U.S. PATENT DOCUMENTS 3,200,827 A * 8/1965 Hill ..... A45D 8/40 132/274
3,265,076 A * 8/1966 Ellis ..... A45D 8/40 132/274
3,268,913 A * 8/1966 Gettinger ..... A42B 1/041 2/171
3,335,502 A * 8/1967 Ritter ..... A45D 20/18 34/99
3,370,304 A * 2/1968 Pelletier ..... A42B 1/061 2/174
3,522,813 A * 8/1970 Corey ..... A42B 1/08 132/274
4,173,042 A * 11/1979 Krzewinski-Morris ..... A42B 1/22 2/174
4,354,496 A * 10/1982 Andersen ..... A61F 7/103 607/110
5,099,865 A * 3/1992 Flannery ..... A45D 19/14 132/212
5,511,249 A * 4/1996 Higgins ..... A42B 1/225 2/195.1

(Continued)

*Primary Examiner* — Gloria M Hale
(74) *Attorney, Agent, or Firm* — Jason T. Daniel, Esq.; Daniel Law Offices, P.A.

(57) ABSTRACT

A constricting hair cap includes an elongated, generally cone-shaped body having a crown section, a middle section and an open bottom end. An elastomeric band is positioned along the bottom end, and a plurality of drawstrings extend upward from the bottom end through an aperture located on the crown section. Each of the drawstrings are positioned within a channel that is located inside the main body and are connected to a cord stop that is positioned adjacent to the aperture along the outside of the main body. Each of the drawstrings are positioned evenly along the main body and function to transition the main body between an extended position and a constricted position upon receiving a pulling force.

8 Claims, 3 Drawing Sheets

(56) References Cited

U.S. PATENT DOCUMENTS

| | | | | |
|---|---|---|---|---|
| 5,708,982 | A * | 1/1998 | Armani | A45D 8/40 2/171 |
| 8,074,297 | B2 * | 12/2011 | Graham | A45D 8/34 2/206 |
| 2002/0095712 | A1 * | 7/2002 | Fayle | A41D 27/205 2/84 |
| 2006/0060155 | A1 * | 3/2006 | Ip | A61D 3/00 119/850 |
| 2006/0179544 | A1 * | 8/2006 | Knievel | A42B 1/225 2/181 |
| 2009/0025119 | A1 * | 1/2009 | Nespor | A41D 7/008 2/84 |
| 2012/0030858 | A1 * | 2/2012 | Duffin | A42B 3/0406 2/183 |
| 2016/0165992 | A1 * | 6/2016 | Brandt | A42B 1/046 2/171.2 |
| 2017/0027262 | A1 * | 2/2017 | Palmer | A42B 1/12 |
| 2018/0184729 | A1 * | 7/2018 | Rybak | A41D 3/00 |
| 2020/0008551 | A1 * | 1/2020 | Clifton | A45D 20/02 |

* cited by examiner

CONSTRICTING HAIR CAP

CROSS-REFERENCE TO RELATED APPLICATIONS

This application claims the benefit of U.S. patent application Ser. No. 62/694,471, filed on Jul. 6, 2018; and, U.S. patent application Ser. No. 62/728,926, filed on Sep. 10, 2019, the contents of which are incorporated herein by reference.

TECHNICAL FIELD

The present invention relates generally to hair drying devices, and more particularly to an improved absorbent constricting hair cap.

BACKGROUND

The statements in this section merely provide background information related to the present disclosure and may not constitute prior art.

When drying long hair, individuals typically wrap an absorbent cotton/polyester towel about their wet hair and then utilize a twisting motion that simultaneously squeezes and twists the hair itself. This constrictive action helps to force the water from the hair and onto the towel. As the drying process can take several minutes, many users will attempt to arrange the twisted towel on their heads so that it will remain in place while the individual perform other tasks. Unfortunately, many times the towel becomes separated and falls from the user's head before the hair is dry, thus causing the individual to repeat the process.

Moreover, although the use of such towels may work well for drying relatively straight hair, it presents several drawbacks for those with textured (e.g., curly or wavy) hair. This is because the twisting motion of the towel causes textured hair to become extremely tangled, and often leads to damage of the hair. Moreover, such towels have a tendency to trap heat, which exacerbates the texture of the hair, often causing the dried hair to become extremely frizzy and difficult to style.

Accordingly, it would be beneficial to provide an improved hair cap that can be utilized with all types of hair and that does not suffer from the drawbacks described above.

SUMMARY OF THE INVENTION

The present invention is directed to a constricting hair cap. One embodiment of the present invention can include an elongated, generally cone-shaped body having a crown section, a middle section and an open bottom end. A resilient band can be positioned along the bottom end to permit securement to the head of a user. In one embodiment, a plurality of drawstrings can extend upward from the bottom end through an aperture located on the crown section of the main body. Each of the drawstrings can be positioned within a channel that is located inside the main body.

In one embodiment, each of the drawstrings can be connected to a cord stop that is positioned adjacent to the aperture along the outside of the main body. Each of the drawstrings are positioned evenly along the main body and function to constrict the main body upon receiving a pulling force.

In one embodiment, the main body is constructed from an absorbent, malleable and breathable microfiber material that functions to absorb water from a user's hair without trapping heat inside the device.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
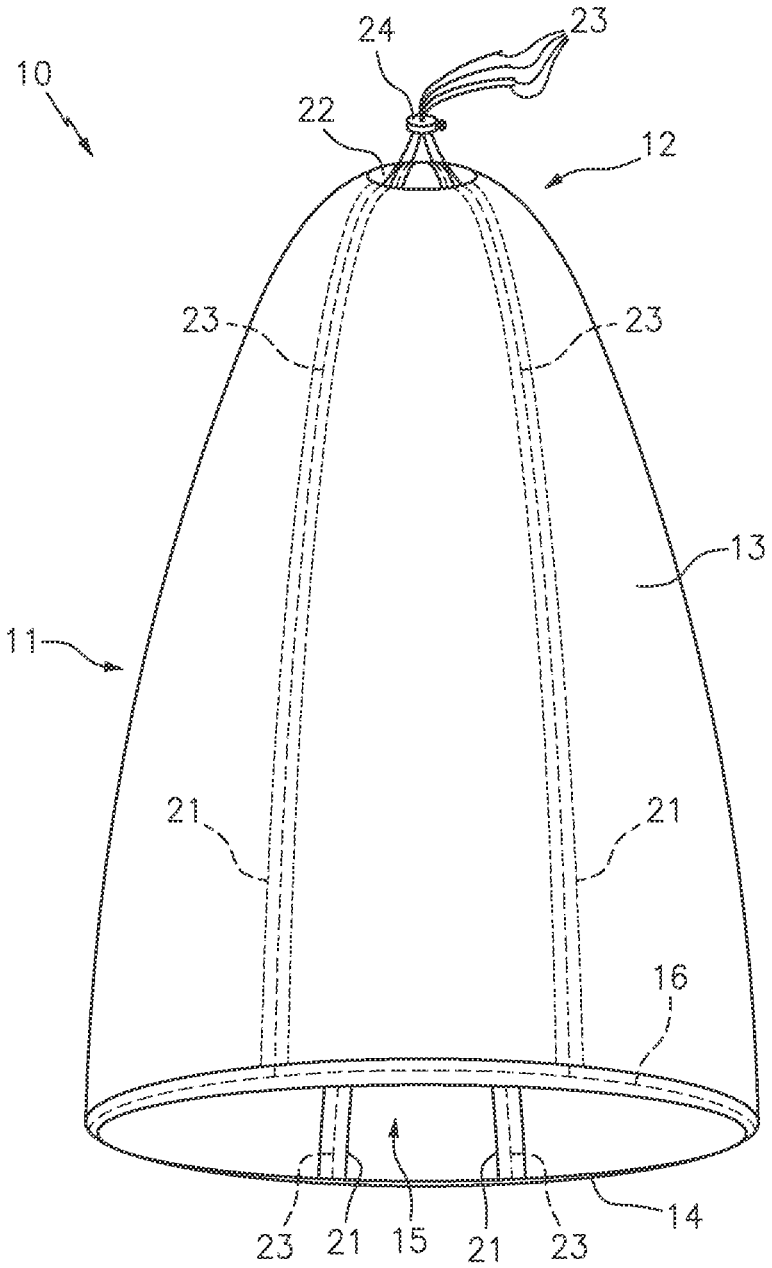
FIG. 1 is a front view of one embodiment of a constricting hair cap that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

As described herein, the term "breathable" refers to the ability of a fabric to allow air to pass through it, and more specifically, a material having a Moisture Vapor transmission rate (MVTR) of greater than 1.

FIGS. 1-4 illustrate one embodiment of a vial with a constricting hair cap 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

FIG. 1 illustrates one embodiment of the cap 10 in the extended position. As shown, the cap 10 can include an elongated main body 11, having a crown section 12, a continuous middle section 13, and a bottom edge 14 that defines an opening 15 for receiving the hair and head of a user.

In the preferred embodiment, the constricting hair cap 10 can include a generally cone-shaped member having a wide downward sloping brim that is constructed from a single layer of highly malleable, absorbent and breathable microfiber material. Of course, the cap is not limited to such a shape or material, as any number of other shapes, materials and/or layers of materials are also contemplated.

In one embodiment, a tensioning mechanism 16 can be disposed within or along the bottom edge 14 so as to allow the cap to expand and contract to the shape and size of a user's head. In the preferred embodiment, the tensioning mechanism can include, comprise or consist of an elastomeric band; however other embodiments using a non-elastic adjustable head band are also contemplated.

In one embodiment, a plurality of channels 21 can be formed along the inside surface of the main body and can extend from the bottom end 14 to an aperture 22 located along the crown section 12. Each of the channels can be positioned uniformly along the main body and can preferably be constructed from an identical material as the main body.

In one embodiment, each of the channels 21 can include an elongated drawstring 23 having a first end that is connected to the tensioning mechanism 16, and a second end that extends out of the channel 21 and through the aperture 22. As shown, an adjustable cord stop 24 can be positioned adjacent to the aperture 22 and can function to receive and engage each of the drawstrings.

Figure 2:
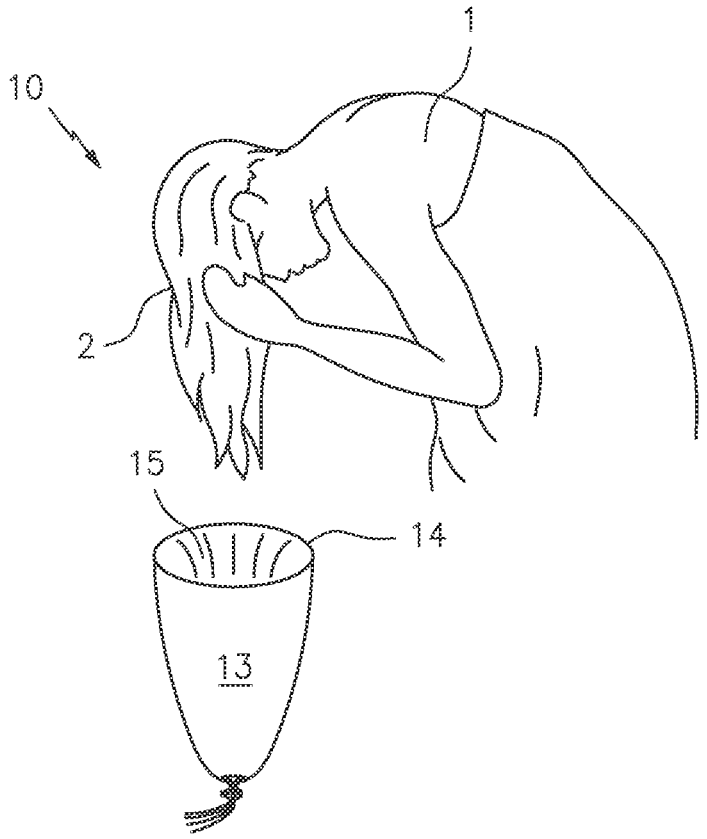
FIG. 2 is a perspective view of the constricting hair cap in operation, in accordance with one embodiment of the invention.
Figure 3:
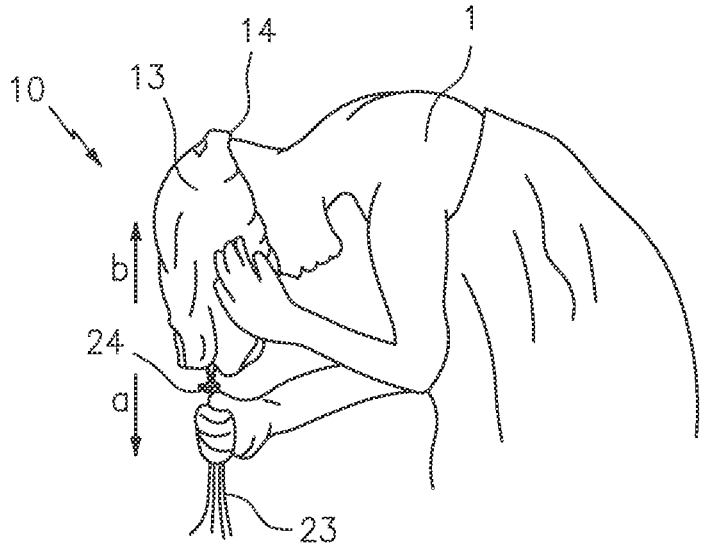
FIG. 3 is another perspective view of the constricting hair cap in operation, in accordance with one embodiment of the invention.

FIGS. 2 and 3 illustrate one embodiment of the cap 10 in operation wherein the inverted cap 10 is positioned beneath the hair 2 of the user 1 that is bent over. Next, the user will position their hair within the inside of the cap 15 and secure the elastomeric bottom edge 14 of the cap around their forehead.

When so positioned, the user can then grasp the cord stop 24 and/or the main body with one hand and pull the drawstrings 23 with the other hand as shown by arrow a. This force causes the crown 12, middle section 13 and the user's hair 2 to constrict in toward the bottom end of the cap 14 as shown by arrow b.

Due to the uniform orientation of the channels, this movement results in the cap applying even pressure to the entirety of the user's hair, without twisting, pulling or otherwise tangling the same. Additionally, due to the breathable nature of the main body material, the cap advantageously does not trap heat or moisture, thus preventing the frizzy outcome caused by the use of a conventional towel.

Figure 4:
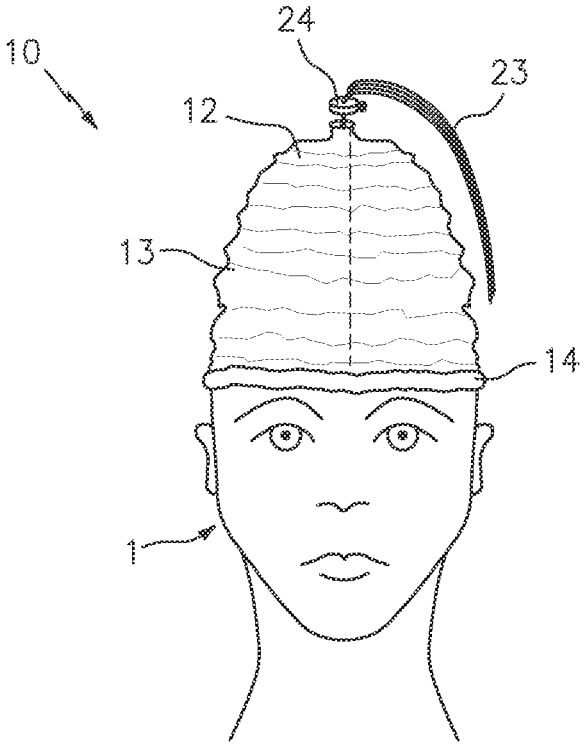
FIG. 4 is a front view of the constricting hair cap in the constricted position, in accordance with one embodiment of the invention.

FIG. 4 illustrates one embodiment of the cap 10 in the constricted position. As shown, once the desired amount of constriction has been achieved, the user can stop the pulling motion and allow the cord stop to maintain the pressure. At this time, the elastomeric bottom 14 can also function to secure the cap onto the user's head, thus resulting in hands free movement by the user.

Although dimensions are not critical, in the preferred embodiment, the cap 10 can include a length (e.g., distance between bottom end 14 and aperture 22) of approximately 18 inches when not constricted (see FIG. 1). Such a length being suitable for allowing complete straight insertion of hair up to 18 inches in length, which is the average length of adult female hair in the United States. Of course, other dimensions are also contemplated.

Accordingly, the above described constricting hair cap provides an innovative means for drying any type of hair without the drawbacks of the prior known devices.

As described herein, one or more elements of the cap 10 can be secured together utilizing any number of known attachment means such as, for example, glue, stitching, or liquid seams, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, or through the use of a singular piece of material manufactured with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A constricting hair cap, comprising:

an elongated cone shaped main body having a crown section, a middle section and an open bottom end;

a tensioning mechanism that is positioned along the open bottom end;

an aperture that is positioned along the crown section in a parallel orientation to the open bottom end;

a plurality of channels that extend between the aperture of the crown section and the open bottom end of the main body;

a plurality of drawstrings that are positioned within the plurality of channels, each of the plurality of drawstrings having a first end that is in communication with the tensioning mechanism and a second end that extends through the aperture; and an adjustable cord stop that is in communication with the second end of each of the plurality of drawstrings, wherein the cord stop is configured to move along a length of each of the plurality of drawstrings to selectively transition the main body between an extended position and a constricted position.

2. The cap of claim 1, wherein each of the plurality of channels are located along an inside portion of the main body.

3. The cap of claim 1, wherein the main body is constructed from an absorbent material.

4. The cap of claim 1, wherein the main body is constructed from a malleable material.

5. The cap of claim 1, wherein the main body is constructed from a breathable fabric material.

6. The cap of claim 1, wherein the main body is constructed from an absorbent, malleable and breathable microfiber material.

7. The cap of claim 1, wherein in the extended position the aperture is spaced apart from the open bottom end at a distance that is equal to a length of each of the plurality of channels.

8. The cap of claim 1, wherein in the constricted position the crown section and the aperture are adjacent to the open bottom end of the main body.

* * * * *